US010633928B2

(12) United States Patent
Scott et al.

(10) Patent No.: US 10,633,928 B2
(45) Date of Patent: Apr. 28, 2020

(54) POLYCRYSTALLINE DIAMOND COMPACTS HAVING LEACH DEPTHS SELECTED TO CONTROL PHYSICAL PROPERTIES AND METHODS OF FORMING SUCH COMPACTS

(71) Applicant: Baker Hughes, a GE company, LLC, Houston, TX (US)

(72) Inventors: Danny E. Scott, Montgomery, TX (US); Wanjun Cao, The Woodlands, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 1076 days.

(21) Appl. No.: 14/815,608

(22) Filed: Jul. 31, 2015

(65) Prior Publication Data

US 2017/0029338 A1 Feb. 2, 2017

(51) Int. Cl.

| | |
|---|---|
| ***B24D 18/00*** | (2006.01) |
| ***E21B 10/567*** | (2006.01) |
| ***E21B 10/55*** | (2006.01) |

(52) U.S. Cl.

CPC ..... *E21B 10/567* (2013.01); *B24D 18/0009* (2013.01); *E21B 10/55* (2013.01)

(58) Field of Classification Search

CPC ..... E21B 10/567; E21B 10/55; B24D 18/00; B24D 18/009; C04B 35/52

See application file for complete search history.

(56) References Cited

U.S. PATENT DOCUMENTS

| | | | |
|---|---|---|---|
| 4,224,380 | A | 9/1980 | Bovenkerk et al. |
| 5,127,923 | A | 7/1992 | Bunting et al. |
| 8,277,722 | B2 | 10/2012 | DiGiovanni |
| 8,496,076 | B2 | 7/2013 | DiGiovanni et al. |

(Continued)

FOREIGN PATENT DOCUMENTS

| | | | |
|---|---|---|---|
| CN | 1252021 | A | 5/2000 |
| CN | 1807668 | A | 7/2006 |

(Continued)

OTHER PUBLICATIONS

Underwood, Quantitative Stereology, Addison-Wesley Publishing Company, Inc., 1970, pp. 103 105.

*Primary Examiner* — Yong-Suk Ro

(74) *Attorney, Agent, or Firm* — TraskBritt

(57) ABSTRACT

A method of forming a polycrystalline diamond compact includes forming a polycrystalline diamond material at a temperature and a pressure sufficient to form diamond-to-diamond bonds in the presence of a catalyst; substantially removing the catalyst from a volume of the polycrystalline diamond material from a first surface to a first leach depth; and substantially removing the catalyst from a volume of the polycrystalline diamond material from a second surface to a second, different leach depth. A polycrystalline diamond compact includes a polycrystalline diamond material having a first volume, a second volume, and a boundary between the first volume and the second volume. The first volume includes a catalyst disposed in interstitial spaces between diamond grains. The second volume is substantially free of the catalyst. The boundary's location is selected to control thermal stability and/or impact resistance.

17 Claims, 5 Drawing Sheets

(56) References Cited

U.S. PATENT DOCUMENTS

| | | | | |
|---|---|---|---|---|
| 8,579,052 | B2 | 11/2013 | DiGiovanni et al. | |
| 8,662,209 | B2 | 3/2014 | Dourfaye et al. | |
| 8,727,042 | B2 | 5/2014 | DiGiovanni | |
| 8,763,731 | B2 * | 7/2014 | Scott | B22F 3/14 175/420.2 |
| 9,714,545 | B2 * | 7/2017 | DiGiovanni | C22C 26/00 |
| 2010/0186304 | A1 | 7/2010 | Burgess et al. | |
| 2010/0307069 | A1 | 12/2010 | Bertagnolli et al. | |
| 2010/0320006 | A1 | 12/2010 | Fan et al. | |
| 2011/0042149 | A1 | 2/2011 | Scott et al. | |
| 2011/0266059 | A1 | 11/2011 | DiGiovanni et al. | |
| 2012/0037431 | A1 | 2/2012 | DiGiovanni et al. | |
| 2012/0080239 | A1 | 4/2012 | Lyons et al. | |
| 2012/0186885 | A1 | 7/2012 | Scott et al. | |
| 2012/0222363 | A1 | 9/2012 | DiGiovanni et al. | |
| 2012/0222364 | A1 | 9/2012 | Lyons et al. | |
| 2012/0225277 | A1 | 9/2012 | Scott | |
| 2012/0261197 | A1 | 10/2012 | Miess et al. | |
| 2013/0092454 | A1 | 4/2013 | Scott et al. | |
| 2013/0333954 | A1 * | 12/2013 | Bellin | E21B 10/5735 175/432 |
| 2014/0069726 | A1 | 3/2014 | Mumma et al. | |
| 2014/0318027 | A1 | 10/2014 | Sani | |
| 2014/0338985 | A1 | 11/2014 | Gonzalez et al. | |
| 2015/0027787 | A1 | 1/2015 | Scott et al. | |
| 2015/0075877 | A1 | 3/2015 | Setlur et al. | |
| 2015/0136495 | A1 | 5/2015 | Knuteson et al. | |
| 2015/0211306 | A1 | 7/2015 | Mukhopadhyay et al. | |

FOREIGN PATENT DOCUMENTS

| | | | |
|---|---|---|---|
| CN | 101589207 | A | 11/2009 |
| CN | 101523014 | B | 2/2013 |
| RU | 2066729 | C1 | 9/1996 |

* cited by examiner

POLYCRYSTALLINE DIAMOND COMPACTS HAVING LEACH DEPTHS SELECTED TO CONTROL PHYSICAL PROPERTIES AND METHODS OF FORMING SUCH COMPACTS

FIELD

Embodiments of the present disclosure relate generally to polycrystalline hard materials, cutting elements, earth-boring tools, and methods of forming such materials, cutting elements, and tools.

BACKGROUND

Earth-boring tools for forming wellbores in subterranean earth formations may include a plurality of cutting elements secured to a body. For example, fixed-cutter earth-boring rotary drill bits (also referred to as "drag bits") include a plurality of cutting elements that are fixedly attached to a bit body of the drill bit. Similarly, roller-cone earth-boring rotary drill bits include cones that are mounted on bearing pins extending from legs of a bit body such that each cone is capable of rotating about the bearing pin on which the cone is mounted. A plurality of cutting elements may be mounted to each cone of the drill bit.

The cutting elements used in earth-boring tools often include polycrystalline diamond compact (often referred to as "PDC") cutters, which are cutting elements that include a polycrystalline diamond (PCD) material. Such polycrystalline diamond cutting elements are formed by sintering and bonding together relatively small diamond grains or crystals under conditions of high pressure and high temperature, typically in the presence of a catalyst (typically including a Group VIII element, such as cobalt, iron, or nickel, or an alloy or mixture having such elements), to form a layer of polycrystalline diamond material on a cutting element substrate. These processes are often referred to as high-pressure/high-temperature (or "HPHT") processes. Catalyst material is mixed with the diamond grains to reduce the amount of oxidation of diamond by oxygen and carbon dioxide during an HPHT process and to promote diamond-to-diamond bonding.

The cutting element substrate may include a cermet material (i.e., a ceramic-metal composite material) such as cobalt-cemented tungsten carbide. In such instances, the cobalt (or other catalyst material) in the cutting element substrate may be drawn into the diamond grains or crystals during sintering and serve as a catalyst material for forming a diamond table from the diamond grains or crystals. In other methods, powdered catalyst material may be mixed with the diamond grains or crystals prior to sintering the grains or crystals together in an HPHT process.

Upon formation of a diamond table using an HPHT process, catalyst material may remain in interstitial spaces between the grains or crystals of diamond in the resulting polycrystalline diamond table. The presence of the catalyst material in the diamond table may contribute to thermal damage in the diamond table when the cutting element is heated during use, due to friction at the contact point between the cutting element and the formation.

Traditional PDC performance relies on the catalyst alloy that sweeps through the compacted diamond feed during HPHT synthesis. Traditional catalyst alloys are cobalt-based with varying amounts of nickel, tungsten, and chromium to facilitate diamond intergrowth between the compacted diamond material. However, in addition to facilitating the formation of diamond-to-diamond bonds during HPHT sintering, these alloys also facilitate the formation of graphite from diamond during drilling. Formation of graphite can rupture diamond necking regions (i.e., grain boundaries) due to an approximate 57% volumetric expansion during the transformation. This phase transformation is known as "back-conversion" or "reverse graphitization," and typically occurs at temperatures approaching 600° C. to 1,000° C., near cutting temperatures experienced during drilling applications. This mechanism, coupled with mismatch of the coefficients of thermal expansion of the metallic phase and diamond is believed to account for a significant part of the general performance criteria known as "thermal stability." From experimental wear conditions, "back-conversion" appears to dominate the thermal stability of a PCD, promoting premature degradation of the cutting edge and performance.

To reduce problems associated with different rates of thermal expansion and with back-conversion in polycrystalline diamond cutting elements, so-called "thermally stable" polycrystalline diamond (TSD) cutting elements have been developed. A TSD cutting element may be formed by leaching the catalyst material (e.g., cobalt) out from interstitial spaces between the diamond grains in the diamond table using, for example, an acid. Substantially all of the catalyst material may be removed from the diamond table, or only a portion may be removed. TSD cutting elements in which substantially all catalyst material has been leached from the diamond table have been reported to be thermally stable up to temperatures of about 1,200° C. It has also been reported, however, that fully leached diamond tables are relatively more brittle and vulnerable to shear, compressive, and tensile stresses than are non-leached diamond tables. In an effort to provide cutting elements having diamond tables that are more thermally stable relative to non-leached diamond tables, but that are also relatively less brittle and vulnerable to shear, compressive, and tensile stresses relative to fully leached diamond tables, cutting elements have been provided that include a diamond table in which only a portion of the catalyst material has been leached from the diamond table.

BRIEF SUMMARY

In some embodiments, a method of forming a polycrystalline diamond compact includes forming a polycrystalline diamond material from diamond particles at a temperature and a pressure sufficient to form diamond-to-diamond bonds in the presence of a catalyst; selecting a first leach depth from a first surface of the polycrystalline diamond material to control at least one of thermal stability and impact resistance; substantially removing the catalyst from a volume of the polycrystalline diamond material from the first surface to the first leach depth; selecting a second, different leach depth from a second surface of the polycrystalline diamond material to control at least one of thermal stability and impact resistance; and substantially removing the catalyst from a volume of the polycrystalline diamond material from the second surface to the second leach depth.

In other embodiments, a polycrystalline diamond compact includes a polycrystalline diamond material having a first volume, a second volume, and a boundary between the first volume and the second volume. The first volume includes a plurality of diamond grains bonded to one another by diamond-to-diamond bonds and a catalyst disposed in interstitial spaces between the diamond grains. The second volume includes a plurality of diamond grains bonded to one another by diamond-to-diamond bonds, and the second volume is substantially free of the catalyst. The boundary has a first leach depth from a first surface of the polycrystalline diamond material and a second, different leach depth from a second surface of the polycrystalline diamond material. The first leach depth and the second leach depth are each selected to control at least one of thermal stability and impact resistance.

In certain embodiments, a method of forming a polycrystalline diamond compact includes forming a polycrystalline diamond material from diamond particles at a temperature and a pressure sufficient to form diamond-to-diamond bonds in the presence of a catalyst; selecting at least one leach depth from at least one surface of the polycrystalline diamond material to optimize thermal stability and impact resistance; and substantially removing the catalyst from a volume of the polycrystalline diamond material from the at least one surface to the at least one leach depth.

BRIEF DESCRIPTION OF THE DRAWINGS

While the specification concludes with claims particularly pointing out and distinctly claiming what are regarded as embodiments of the present disclosure, various features and advantages of embodiments of the disclosure may be more readily ascertained from the following description of example embodiments of the disclosure when read in conjunction with the accompanying drawings, in which:

DETAILED DESCRIPTION

Figure 1:
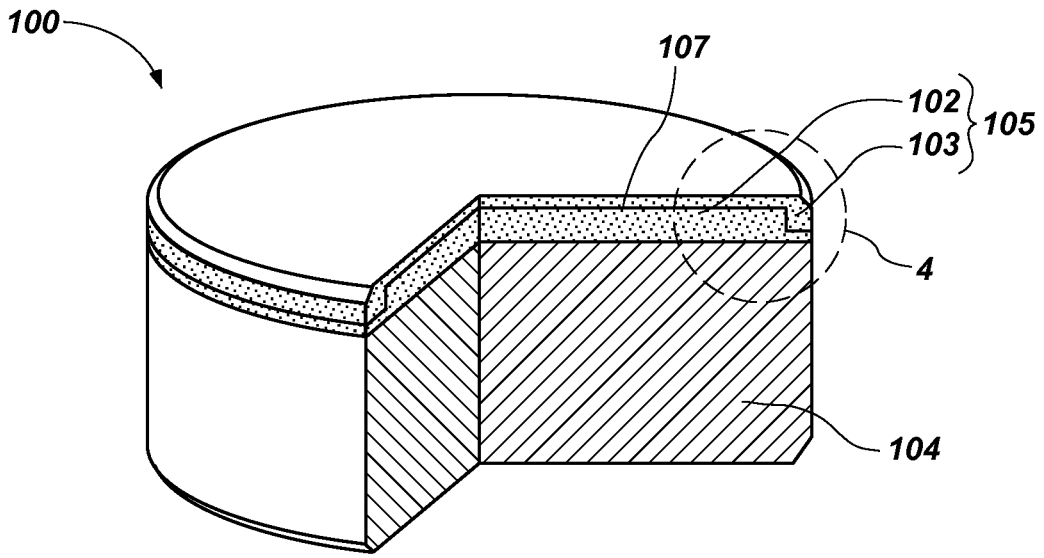
FIG. 1 is a partially cut-away perspective view of an embodiment of a cutting element (i.e., a polycrystalline compact) including a polycrystalline hard material on a substrate.

The illustrations presented herein are not actual views of any particular cutting elements or tools, but are merely idealized representations that are employed to describe example embodiments of the present disclosure. Additionally, elements common between figures may retain the same numerical designation.

As used herein, the term "particle" means and includes any coherent volume of solid matter having an average dimension of about 500 μm or less. Grains (i.e., crystals) and coated grains are types of particles. As used herein, the term "nanoparticle" means and includes any particle having an average particle diameter of about 500 nm or less. Nanoparticles include grains in a polycrystalline hard material having an average grain size of about 500 nm or less.

As used herein, the term "hard material" means and includes any material having a Knoop hardness value of about 3,000 $Kg_f/mm^2$ (29,420 MPa) or more. Hard materials include, for example, diamond and cubic boron nitride.

As used herein, the term "inter-granular bond" means and includes any direct atomic bond (e.g., covalent, metallic, etc.) between atoms in adjacent grains of material.

As used herein, the terms "nanodiamond" and "diamond nanoparticles" mean and include any single, polycrystalline, or agglomeration of nanocrystalline carbon material comprising a mixture of sp-3 and sp-2 bonded carbon wherein the individual particle or crystal, whether singular or part of an agglomerate, is primarily made up of sp-3 bonds. Commercial nanodiamonds are typically derived from detonation sources (UDD) and crushed sources and can be naturally occurring or manufactured synthetically. Naturally occurring nanodiamond includes the natural lonsdaleite phase identified with meteoric deposits.

As used herein, the term "polycrystalline hard material" means and includes any material comprising a plurality of grains or crystals of the material that are bonded directly together by inter-granular bonds. The crystal structures of the individual grains of polycrystalline hard material may be randomly oriented in space within the polycrystalline hard material.

As used herein, the term "polycrystalline compact" means and includes any structure comprising a polycrystalline hard material comprising inter-granular bonds formed by a process that involves application of pressure (e.g., compaction) to the precursor material or materials used to form the polycrystalline hard material.

As used herein, the term "earth-boring tool" means and includes any type of bit or tool used for drilling during the formation or enlargement of a wellbore and includes, for example, rotary drill bits, percussion bits, core bits, eccentric bits, bi-center bits, reamers, mills, drag bits, roller-cone bits, hybrid bits, and other drilling bits and tools known in the art.

Cutting elements described herein may exhibit improved performance in comparison to conventional cutting elements. In particular, it has been unexpectedly found that high-impact, thermally stable cutting elements can be formed having one or more leach depths from one or more surfaces of polycrystalline hard material. Rather than leaching as deep as possible, relatively shallower leaches may retain impact resistance yet gain thermal stability as compared to unleached polycrystalline hard materials.

FIG. 1 illustrates a cutting element 100, which may be formed as disclosed herein. The cutting element 100 includes a polycrystalline hard material 105, which may include volumes 102 and 103 in contact with one another at a boundary 107. Typically, the polycrystalline hard material 105 may be polycrystalline diamond. Optionally, the cutting element 100 may also include a substrate 104 to which the polycrystalline hard material 105 may be bonded, or on which the polycrystalline hard material 105 is formed under the aforementioned HPHT conditions. For example, the substrate 104 may include a generally cylindrical body of cobalt-cemented tungsten carbide material, although substrates of different geometries and compositions may also be employed. The polycrystalline hard material 105 may be in the form of a table (i.e., a layer) of polycrystalline hard material 105 on the substrate 104, as shown in FIG. 1. The polycrystalline hard material 105 may be provided on (e.g., formed on or secured to) a surface of the substrate 104. In additional embodiments, the cutting element 100 may simply be a volume of the polycrystalline hard material 105 having any desirable shape, and may not include any substrate 104. The cutting element 100 may be referred to as "polycrystalline compact," or, if the polycrystalline hard material 105 includes diamond, as a "polycrystalline diamond compact."

Figure 2:
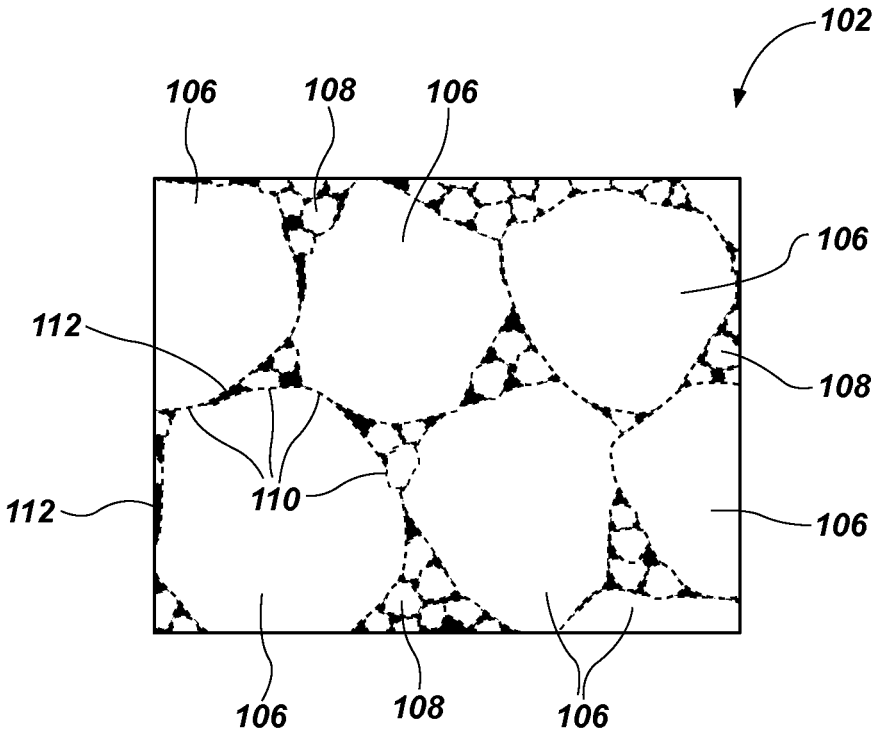
FIG. 2 is a simplified view illustrating how a microstructure of a volume of the polycrystalline hard material of the cutting element of FIG. 1 may appear under magnification.
Figure 3:
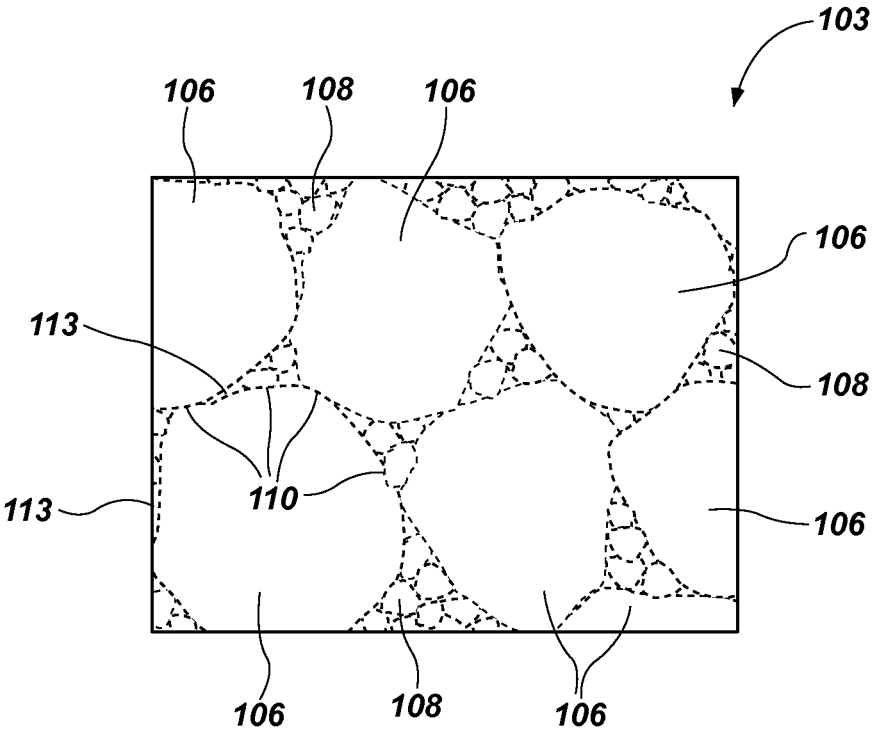
FIG. 3 is a simplified view illustrating how a microstructure of another volume of the polycrystalline hard material of the cutting element of FIG. 1 may appear under magnification.

FIGS. 2 and 3 are simplified views illustrating how microstructures of the volumes 102, 103 of the polycrystalline hard material 105 of the cutting element 100 of FIG. 1 may appear under magnification.

As shown in FIGS. 2 and 3, the volumes 102, 103 of the polycrystalline hard material 105 may each include interspersed and inter-bonded grains forming a three-dimensional network of hard material. Optionally, in some embodiments, the grains of the polycrystalline hard material 105 may have a multimodal (e.g., bi-modal, tri-modal, etc.) grain size distribution. For example, the polycrystalline hard material 105 may comprise a multi-modal grain size distribution as disclosed in at least one of U.S. Pat. No. 8,579,052, issued Nov. 12, 2013, and titled "Polycrystalline Compacts Including In-Situ Nucleated Grains, Earth-Boring Tools Including Such Compacts, and Methods of Forming Such Compacts and Tools"; U.S. Pat. No. 8,727,042, issued May 20, 2014, and titled "Polycrystalline Compacts Having Material Disposed in Interstitial Spaces Therein, and Cutting Elements Including Such Compacts"; and U.S. Pat. No. 8,496,076, issued Jul. 30, 2013, and titled "Polycrystalline Compacts Including Nanoparticulate Inclusions, Cutting Elements and Earth-Boring Tools Including Such Compacts, and Methods of Forming Such Compacts"; the disclosures of each of which are incorporated herein in their entireties by this reference.

For example, in some embodiments, the polycrystalline hard material 105 may include larger grains 106 and smaller grains 108. The larger grains 106 and/or the smaller grains 108 may have average particle dimensions (e.g., mean diameters) of less than 0.5 mm, less than 0.1 mm, less than 0.01 mm, less than 1 μm, less than 0.1 μm, or even less than 0.01 μm. That is, the larger grains 106 and smaller grains 108 may each include micron-sized particles (grains having an average particle diameter in a range from about 1 μm to about 500 μm (0.5 mm)), submicron-sized particles (grains having an average particle diameter in a range from about 500 nm (0.5 μm) to about 1 μm), and/or nanoparticles (particles having an average particle diameter of about 500 nm or less). In some embodiments, the larger grains 106 may be micron-sized diamond particles, and the smaller grains 108 may be submicron diamond particles or diamond nanoparticles. In some embodiments, the larger grains 106 may be submicron diamond particles, and the smaller grains 108 may be diamond nanoparticles. In other embodiments, the grains of the polycrystalline hard material 105 may have a monomodal grain size distribution. The polycrystalline hard material 105 may include direct inter-granular bonds 110 between the grains 106, 108, represented in FIGS. 2 and 3 by dashed lines. If the grains 106, 108 are diamond particles, the direct inter-granular bonds 110 may be diamond-to-diamond bonds. Interstitial spaces are present between the inter-bonded grains 106, 108 of the polycrystalline hard material 105. As shown in FIG. 2, a catalyst 112 may reside in some or all of the interstitial spaces unoccupied by the grains 106, 108 of the volume 102 of the polycrystalline hard material 105 (FIG. 1).

As shown in FIG. 3, the volume 103 of the polycrystalline hard material 105 (FIG. 1) may include voids 113 in the interstitial spaces. The voids 113 may be free of solid or liquid substances (although a gas, such as air, may be present in the voids 113). The voids 113 may be formed by removal of the catalyst 112 (see FIG. 2) from the polycrystalline hard material 105.

As used herein, the term "grain size" means and includes a geometric mean diameter measured from a two-dimensional section through a bulk material. The geometric mean diameter for a group of particles may be determined using techniques known in the art, such as those set forth in Ervin E. Underwood, QUANTITATIVE STEREOLOGY, 103-105 (Addison-Wesley Publishing Company, Inc., 1970), the disclosure of which is incorporated herein in its entirety by this reference. As known in the art, the average grain size of grains within a microstructure may be determined by measuring grains of the microstructure under magnification. For example, a scanning electron microscope (SEM), a field emission scanning electron microscope (FESEM), or a transmission electron microscope (TEM) may be used to view or image a surface of a polycrystalline hard material 105 (e.g., a polished and etched surface of the polycrystalline hard material 105). Commercially available vision systems are often used with such microscopy systems, and these vision systems are capable of measuring the average grain size of grains within a microstructure.

Figure 4:
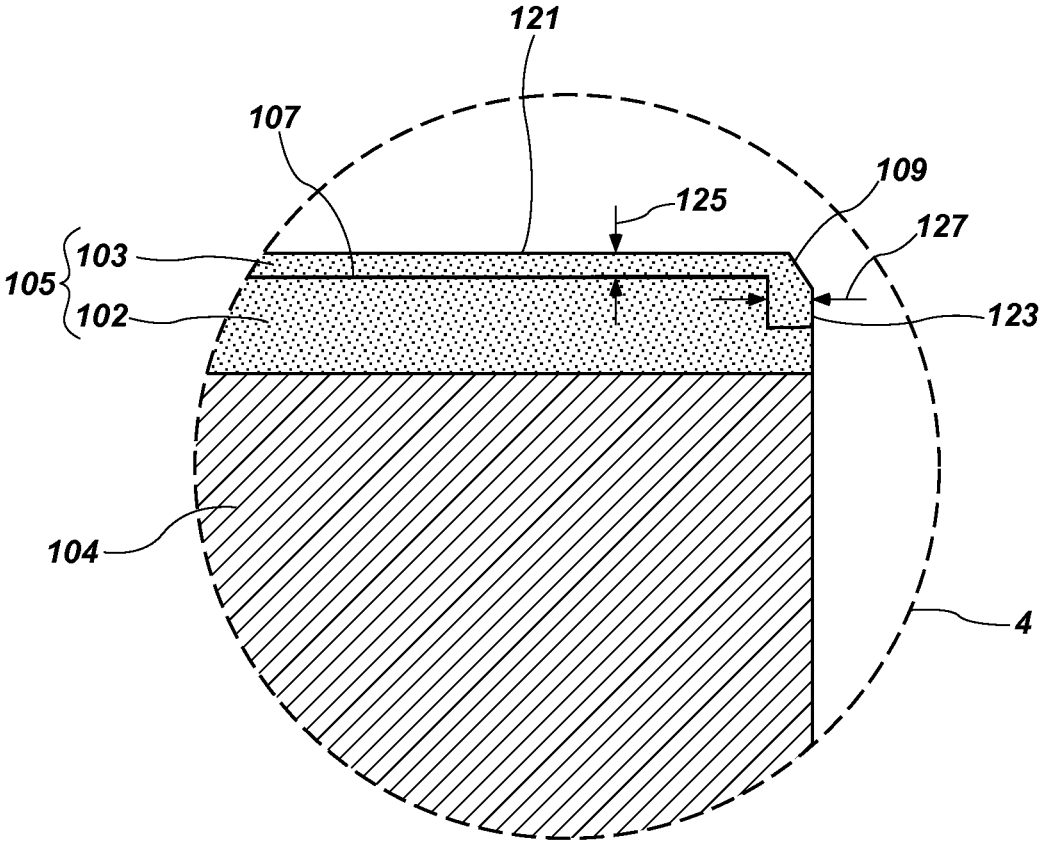
FIG. 4 is a simplified cross-sectional side view illustrating a portion of the cutting element shown in FIG. 1.

FIG. 4 is a simplified cross-sectional side view illustrating a portion 4 of the cutting element 100 shown in FIG. 1. The cutting element 100 includes the volumes 102, 103 of the polycrystalline hard material 105. The polycrystalline hard material 105 may have exposed surfaces, such as a cutting face 121, a side surface 123, and a chamfer 109. The cutting face 121 may be substantially planar, or may have any other selected shape. The side surface 123 may be substantially cylindrical, or any other selected shape. For example, in some embodiments, the side surface 123 may include a plurality of planar surfaces surrounding the cutting element 100. The shape of the chamfer 109, if present, may be selected to improve performance of the cutting element 100.

As discussed above with respect to FIGS. 2 and 3, the volume 102 may include catalyst 112 and the volume 103 may be substantially free of the catalyst 112. The boundary 107 may define the extent of the volumes 102, 103 with respect to one another. The boundary 107 may be disposed at a depth 125 from the cutting face 121 and at a depth 127 from the side surface 123. The depth 125 and the depth 127 may also be referred to as "leach depths" because catalyst 112 may be removed from the volume 103 by leaching.

The magnitudes of the depth 125 and the depth 127 may be selected to control one or more physical properties of the cutting element 100. For example, the magnitudes of the depth 125 and the depth 127 may be selected to control thermal stability or impact resistance. The magnitudes of the depth 125 and the depth 127 may be selected to, in combination, provide an enhanced combination of thermal stability and impact resistance. In some embodiments, the depths 125, 127 may be from about 50 μm to about 600 μm. For example, when impact resistance is a primary objective, the depths 125, 127 may be from about 100 μm to about 1,000 μm from about 100 μm to about 800 μm, from about 100 μm to about 500 μm, from about 300 μm to about 400 μm, or from about 800 μm to about 1,000 μm. When thermal stability is a primary objective, the depths 125, 127 may be greater than about 400 μm.

In some embodiments, the depth 125 may be different than the depth 127. For example, the depth 127 may be relatively larger than the depth 125 to impart a relatively higher thermal stability to the polycrystalline hard material 105 adjacent the side surface 123 and a relatively higher impact resistance to the polycrystalline hard material 105 adjacent the cutting face 121. In certain embodiments, the depth 127 may be from about 300 μm to about 600 μm, and the depth 125 may be from about 100 μm to about 300 μm. In some embodiments, the depth 125 may be the same as the depth 127. In other embodiments, the depth 125 may be larger than the depth 127. The depths 125, 127 may be based on failure modes observed during modeling and/or testing, and thus may be selected based at least in part on properties of formation materials expected to be encountered in drilling operations.

Figure 6:
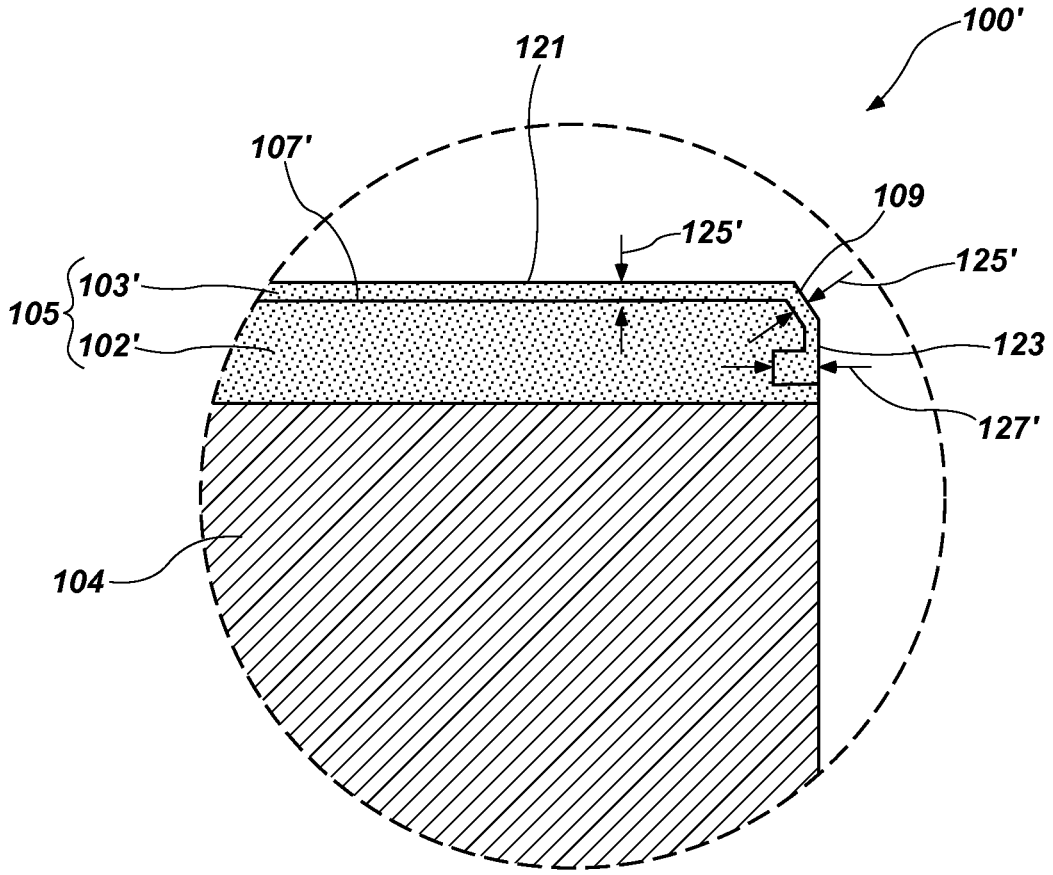
FIG. 6 is a simplified cross-sectional side view illustrating a portion of another cutting element.

FIG. 6 is a simplified cross-sectional side view illustrating a portion of another cutting element 100'. The cutting element 100' includes volumes 102', 103' of polycrystalline hard material 105, a cutting face 121, a side surface 123, and a chamfer 109. A boundary 107' between the volumes 102', 103' may include various leach depths 125', 127'. For example, the cutting face 121 and the chamfer 109 may each be leached to a depth 125', and a portion of the side surface 123 may be leached to a deeper depth 127'. When such a cutting element 100' is used for drilling a subterranean formation, the cutting element 100' may have two cutting edges (i.e., at the intersection between the cutting face 121 and the chamfer 109, and at the intersection between the chamfer 109 and the side surface 123. The more shallow leach depth 125' may impart relatively higher impact resistance to both cutting edges, while the deeper leach depth 127' below the side surface 123 may impart relatively higher thermal stability to the cutting element 100'. The cutting element 100' may therefore exceed the performance of conventional cutting elements in two properties that are inversely related in conventional cutting elements.

In still other embodiments, the leach depth 125' of the chamfer 109 may be different from the leach depth 125' of the cutting face 121. In some embodiments, the leach depths 125, 127 (FIG. 4) may be substantially the same. The depths 125, 127 may be selected to balance impact resistance and thermal stability. For example, the depths 125, 127 may be from about 200 μm to about 500 μm, or from about 300 μm to about 400 μm.

The polycrystalline hard material 105 may be formed by an HPHT sintering process, as known in the art and not described in detail herein. For example, HPHT processing of particulate material is described in U.S. Pat. No. 8,763,731, issued Jul. 1, 2014, and titled "Polycrystalline Compacts Having Differing Regions Therein, Cutting Elements and Earth-Boring Tools Including Such Compacts, and Methods of Forming Such Compacts," the entire disclosure of which is hereby incorporated herein by reference. For example, particulate matter and catalyst may be placed in a container, which may optionally include a substrate, and the container may be heated and pressurized. The HPHT processing may cause the formation of inter-granular bonds between the particles. For example, if the particles include diamond, then HPHT processing may cause the formation of diamond-to-diamond bonds.

To catalyze the formation of inter-granular bonds, the particulate material may be physically exposed to catalyst material during the HPHT process. The catalyst material may include one or more transition metals. For example, the catalyst material may include cobalt, iron, nickel, or an alloy or mixture thereof. If the substrate 104 (FIG. 1) includes a catalyst material, however, the catalyst material may be swept from the surface of the substrate 104 into the polycrystalline hard material 105 during HPHT sintering, and catalyze the formation of inter-granular bonds between the grains in the particulate matter. In such instances, it may not be necessary or desirable to include catalyst material in the volume of particulate matter to be sintered.

The polycrystalline hard material 105 may be formed on a substrate 104, as shown in FIG. 1, or may be formed as a freestanding structure. In some embodiments, the polycrystalline hard material 105 may be formed and processed as described below, and may be subsequently bonded to a substrate 104.

The catalyst 112 may be removed from a volume 103 of the polycrystalline hard material 105 by various means, such as by hot-acid leaching, vacuum leaching, electrolytic removal of the catalyst 112, or any other process. The volume 103 may then be substantially free of the catalyst 112. The volume 102 of the polycrystalline hard material 105 may retain substantially all the catalyst 112 formed therein during the HPHT process.

The location and shape of the boundary 107 may be selected to control one or more physical properties of the polycrystalline hard material 105 or the cutting element 100. For example, the location and shape of the boundary 107 may determine the thermal stability, impact resistance, density, hardness, or other property of the polycrystalline hard material 105. Thus, changing the location and shape of the boundary 107 may change the performance of the cutting element 100 in a particular application. For example, a change in the location and shape of the boundary 107 may improve the performance of a certain cutting element 100 in relatively harder formations, but may simultaneously diminish the performance of the cutting element 100 in relatively softer formations.

In some embodiments, the boundary 107 may have a substantially flat portion and a substantially cylindrical portion. For example, as shown in FIG. 4, a portion of the boundary 107 below the cutting face 121 may be located at the depth 125 from the cutting face 121. A cylindrical portion of the boundary 107 may be located at the depth 127 from the side surface 123. If the side surface 123 is substantially cylindrical, the corresponding portion of the boundary 107 may also be cylindrical. If the side surface 123 is not substantially cylindrical (e.g., if the side surface 123 includes flat surfaces), the corresponding portion of the boundary 107 may have any corresponding shape to provide a uniform depth 127 between the boundary 107 and the side surface 123.

The depths 125, 127 between the boundary 107 and the cutting face 121 or side surface 123 may be the same or different. For example, the depth 127 may be selected to be relatively larger than the depth 125 to provide improved thermal stability of the portion of the polycrystalline hard material 105 near the side surface 123 and improved impact resistance near the cutting face 121. In some embodiments, the depth 127 may be at least 1.5 times the depth 125, at least 2.0 times the depth 125, at least 2.5 times the depth 125, or even at least 3.0 times the depth 125. The depth 125 may be from about 50 μm to about 600 μm, such as from about 100 μm to about 500 μm or from about 300 μm to about 400 μm. The depth 127 may be from about 100 μm to about 1,500 μm, such as from about 200 μm to about 800 μm or from about 300 μm to about 600 μm.

A portion of the catalyst 112 may be removed from the polycrystalline hard material 105 (see FIG. 1) after the HPHT process using processes known in the art. The catalyst 112 may be removed by transferring the catalyst 112 through the cutting face 121 and/or the side surface 123 of the polycrystalline hard material 105. For example, a leaching process may be used to remove the catalyst 112 from the interstitial spaces between the grains 106, 108 in the volume 103 of the polycrystalline hard material 105. By way of example and not limitation, the volume 103 of the polycrystalline hard material 105 may be leached using a leaching agent and process such as those described more fully in, for example, U.S. Pat. No. 5,127,923, issued Jul. 7, 1992, and titled "Composite Abrasive Compact Having High Thermal Stability"; and U.S. Pat. No. 4,224,380, issued Sep. 23, 1980, and titled "Temperature Resistant Abrasive Compact and Method for Making Same"; the disclosure of each of which is incorporated herein in its entirety by this reference. Specifically, aqua regia (a mixture of concentrated nitric acid ($HNO_3$) and concentrated hydrochloric acid (HCl)) may be used to at least substantially remove catalyst 112 from the interstitial spaces. It is also known to use boiling HCl and boiling hydrofluoric acid (HF) as leaching agents. One particularly suitable leaching agent is HCl at a temperature of above about 110° C., which may be provided in contact with one or more surfaces of the polycrystalline hard material 105 for a period of about two (2) hours to about sixty (60) hours, depending upon the size of the body of polycrystalline hard material 105. After leaching the polycrystalline hard material 105, some of the interstitial spaces between the inter-bonded grains 106, 108 of hard material within the polycrystalline hard material 105 subjected to the leaching process may be at least substantially free of catalyst 112 used to catalyze formation of inter-granular bonds 110 between the grains 106, 108.

To form the boundary 107 in a selected shape and location, the catalyst 112 may be removed from the cutting face 121 and/or the side surface 123 in separate acts, or in a first act wherein catalyst 112 is first removed from the side surface 123 and then subsequently removed from both the side surface 123 and the cutting face 121, or vice versa. For example, if the depth 127 is selected to be larger than the depth 125, the cutting face 121 may be masked (e.g., by a rubber disk, an elastomeric coating, a wax, etc.) while the side surface 123 is exposed to a leaching process. The mask may subsequently be removed, and both the side surface 123 and the cutting face 121 may be exposed to another leaching process (which may be the same or different from the prior process). In some embodiments, the leaching processes may be reversed, such that both the side surface 123 and the cutting face 121 are leached first, and the cutting face 121 is masked during a second leaching process. In other embodiments, the cutting face 121 may be masked while leaching the side surface 123, and the side surface 123 may be masked while leaching the cutting face 121. If the depth 127 is selected to be smaller than the depth 125, the side surface 123 may be masked while the cutting face 121 is leached, then the mask may be removed to leach the side surface 123 while further leaching the cutting face 121.

In some embodiments, a backfill material may be provided in at least a portion of the polycrystalline hard material 105. For example, a backfill material may be provided as described in U.S. Pat. No. 8,662,209, issued Mar. 4, 2014, and titled "Backfilled Polycrystalline Diamond Cutter with High Thermal Conductivity," the disclosure of which is incorporated herein in its entirety by this reference. The backfill material may have the same composition as the catalyst 112, or may have a different composition. The backfill material may be selected to improve thermal properties of the polycrystalline hard material 105. For example, the backfill material may include a material selected to have a lower coefficient of thermal expansion than the catalyst 112. In some embodiments, the backfill material may include silicon carbide. In some embodiments, the backfill material may include Al, Cu, Ag, or an alloy of one or more of these elements. In some embodiments, the backfill material may be present in substantially all of the volume 103. In certain embodiments, the polycrystalline hard material 105 may be leached deeper than is desired in the finished cutting element 100, and the backfill material may be provided to change the location of the boundary 107 (e.g., by providing a backfill material having the same composition as the catalyst 112).

Figure 5:
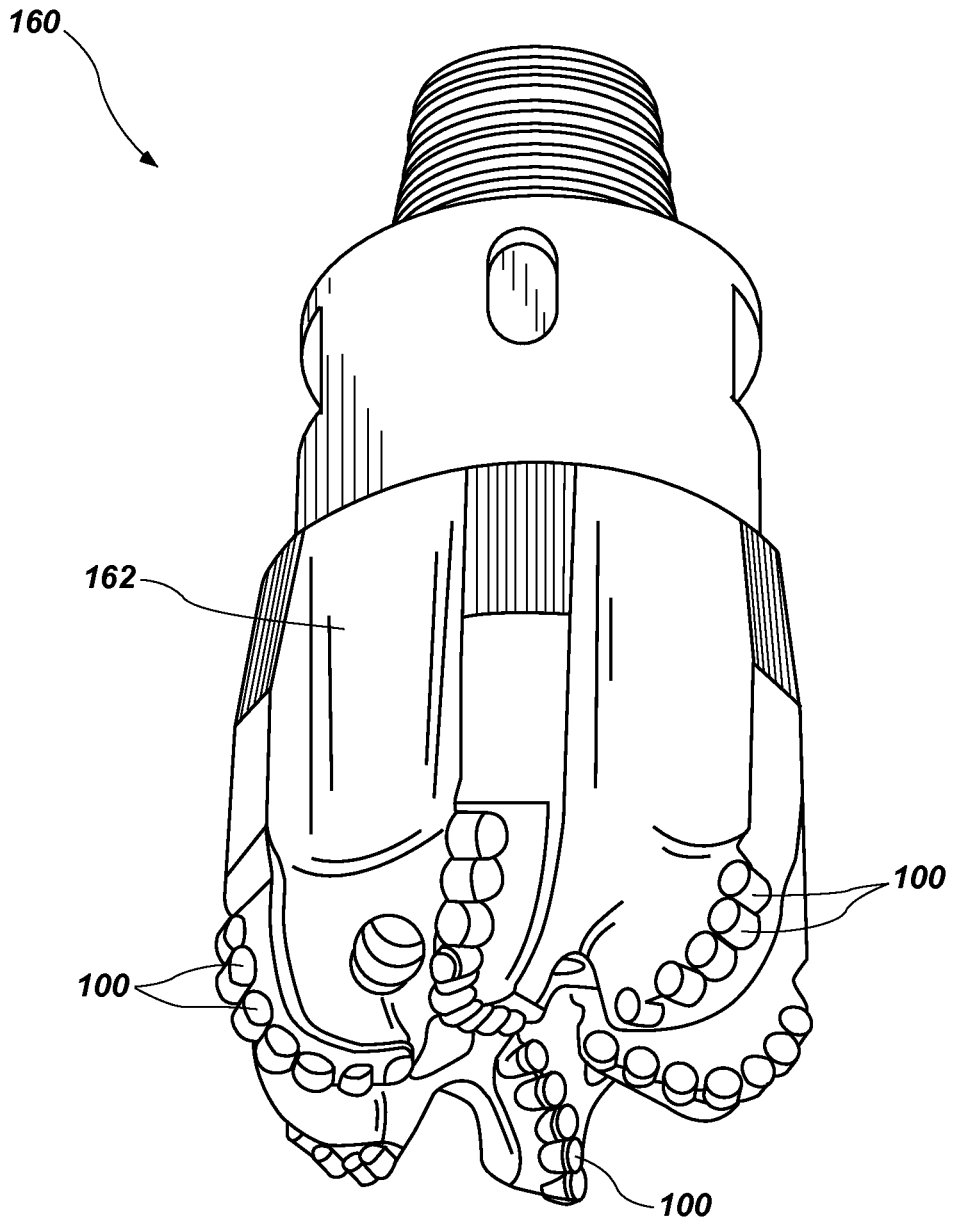
FIG. 5 illustrates an earth-boring rotary drill bit having cutting elements as shown in FIG. 1.

Embodiments of cutting elements 100 (FIG. 1) that include polycrystalline hard material 105 fabricated as described herein may be mounted to earth-boring tools and used to remove subterranean formation material. FIG. 5 illustrates a fixed-cutter earth-boring rotary drill bit 160. The drill bit 160 includes a bit body 162. One or more cutting elements 100 as described herein may be mounted on the bit body 162 of the drill bit 160. The cutting elements 100 may be brazed or otherwise secured within pockets formed in the outer surface of the bit body 162. Other types of earth-boring tools, such as roller cone bits, percussion bits, hybrid bits, reamers, etc., also may include cutting elements 100 as described herein.

Additional non limiting example embodiments of the disclosure are described below.

Embodiment 1: A method of forming a polycrystalline diamond compact, comprising forming a polycrystalline diamond material from diamond particles at a temperature and a pressure sufficient to form diamond-to-diamond bonds in the presence of a catalyst; selecting a first leach depth from a first surface of the polycrystalline diamond material to control at least one of thermal stability and impact resistance; substantially removing the catalyst from a volume of the polycrystalline diamond material from the first surface to the first leach depth; selecting a second, different leach depth from a second surface of the polycrystalline diamond material to control at least one of thermal stability and impact resistance; and substantially removing the catalyst from a volume of the polycrystalline diamond material from the second surface to the second leach depth.

Embodiment 2: The method of Embodiment 1, wherein forming a polycrystalline diamond material comprises forming the polycrystalline diamond material on a supporting substrate.

Embodiment 3: The method of Embodiment 1, wherein forming a polycrystalline diamond material comprises forming the polycrystalline diamond material as a freestanding structure.

Embodiment 4: The method of any of Embodiments 1 through 3, wherein the first surface comprises a cutting face of the polycrystalline diamond material, and wherein the second surface comprises a side surface of the polycrystalline diamond material.

Embodiment 5: The method of any of Embodiments 1 through 4, wherein substantially removing the catalyst from a volume of the polycrystalline diamond material from the second surface to the second leach depth comprises removing the catalyst through the second surface without substantially removing the catalyst through the first surface; and removing the catalyst through the second surface and the first surface simultaneously.

Embodiment 6: The method of Embodiment 5, further comprising masking the first surface before removing the catalyst through the second surface without substantially removing the catalyst through the first surface.

Embodiment 7: The method of any of Embodiments 1 through 6, wherein substantially removing the catalyst from the volume of the polycrystalline diamond material comprises leaching the catalyst.

Embodiment 8: The method of any of Embodiments 1 through 7, further comprising providing a backfill material into the volume of the polycrystalline diamond material.

Embodiment 9: The method of Embodiment 8, wherein the catalyst and the backfill material each comprise substantially the same material.

Embodiment 10: The method of Embodiment 8, wherein the backfill material exhibits a coefficient of thermal expansion lower than a coefficient of thermal expansion of the catalyst.

Embodiment 11: The method of any of Embodiments 1 through 10, wherein the catalyst comprises a Group VIII element or an alloy thereof.

Embodiment 12: A polycrystalline diamond compact comprising a polycrystalline diamond material comprising a first volume, a second volume, and a boundary between the first volume and the second volume. The first volume comprises a plurality of diamond grains bonded to one another by diamond-to-diamond bonds and a catalyst disposed in interstitial spaces between the diamond grains. The second volume comprises a plurality of diamond grains bonded to one another by diamond-to-diamond bonds, and the second volume is substantially free of the catalyst. The boundary comprises a first leach depth from a first surface of the polycrystalline diamond material and a second, different leach depth from a second surface of the polycrystalline diamond material. The first leach depth and the second leach depth are each selected to control at least one of thermal stability and impact resistance.

Embodiment 13: The polycrystalline diamond compact of Embodiment 12, wherein the polycrystalline diamond material is secured to a supporting substrate.

Embodiment 14: The polycrystalline diamond compact of Embodiment 12, wherein the polycrystalline diamond material comprises a freestanding structure.

Embodiment 15: The polycrystalline diamond compact of any of Embodiments 12 through 14, wherein the first surface comprises a cutting face of the polycrystalline diamond material, and wherein the second surface comprises a side surface of the polycrystalline diamond material.

Embodiment 16: The polycrystalline diamond compact of any of Embodiments 12 through 15, wherein the second leach depth is greater than the first leach depth.

Embodiment 17: The polycrystalline diamond compact of any of Embodiments 12 through 16, wherein the diamond grains comprise nanodiamond grains.

Embodiment 18: The polycrystalline diamond compact of any of Embodiments 12 through 17, wherein the boundary comprises a third leach depth from a third surface of the polycrystalline diamond material.

Embodiment 19: The polycrystalline diamond compact of Embodiment 18, wherein the third leach depth is equal to the first leach depth or the second leach depth.

Embodiment 20: An earth-boring tool comprising a bit body and the polycrystalline diamond compact of any of Embodiments 12 through 19.

Embodiment 21: A method of forming a polycrystalline diamond compact, the method comprising: forming a polycrystalline diamond material from diamond particles at a temperature and a pressure sufficient to form diamond-to-diamond bonds in the presence of a catalyst; selecting at least one leach depth from at least one surface of the polycrystalline diamond material to optimize thermal stability and impact resistance; and substantially removing the catalyst from a volume of the polycrystalline diamond material from the at least one surface to the at least one leach depth.

While the present invention has been described herein with respect to certain illustrated embodiments, those of ordinary skill in the art will recognize and appreciate that it is not so limited. Rather, many additions, deletions, and modifications to the illustrated embodiments may be made without departing from the scope of the invention as hereinafter claimed, including legal equivalents thereof In addition, features from one embodiment may be combined with features of another embodiment while still being encompassed within the scope of the invention as contemplated by the inventors. Further, embodiments of the disclosure have utility with different and various types and configurations of tools and materials.

What is claimed is:

1. A method of forming a polycrystalline diamond compact, the method comprising:

forming a polycrystalline diamond material from diamond particles at a temperature and a pressure sufficient to form diamond-to-diamond bonds in the presence of a catalyst;

selecting a leach depth from a first surface of the polycrystalline diamond material to control at least one of thermal stability and impact resistance;

substantially removing the catalyst from a volume of the polycrystalline diamond material from the first surface to the leach depth from the first surface to form a first leached region adjacent an unleached region, the unleached region comprising another volume of the polycrystalline diamond material retaining catalyst therein;

selecting a different leach depth from a second surface of the polycrystalline diamond material to control at least one of thermal stability and impact resistance; and substantially removing the catalyst from a volume of the polycrystalline diamond material from the second surface to the different leach depth to form a second leached region adjacent the unleached region.

2. The method of claim 1, wherein forming a polycrystalline diamond material comprises forming the polycrystalline diamond material on a supporting substrate.

3. The method of claim 1, wherein forming a polycrystalline diamond material comprises forming the polycrystalline diamond material as a freestanding structure.

4. The method of claim 1, wherein the first surface comprises a cutting face of the polycrystalline diamond material, and wherein the second surface comprises a side surface of the polycrystalline diamond material.

5. The method of claim 4, wherein selecting a different leach depth from a second surface of the polycrystalline diamond material comprises selecting the different leach depth to be greater than the leach depth.

6. The method of claim 4, wherein selecting the different leach depth from the second surface to be greater than the leach depth from the first surface comprises selecting the different leach depth to be at least 1.5 times the leach depth.

7. The method of claim 4, wherein selecting a different leach depth from a second surface of the polycrystalline diamond material comprises selecting the different depth to be in a range from about 300 μm to about 600 μm.

8. The method of claim 4, wherein selecting a leach depth from a first surface of the polycrystalline diamond material comprises selecting the depth to be in a range from about 100 μm to about 300 μm.

9. The method of claim 1, wherein substantially removing the catalyst from a volume of the polycrystalline diamond material from the second surface to the different leach depth comprises:

removing the catalyst through the second surface without substantially removing the catalyst through the first surface; and removing the catalyst through the second surface and the first surface simultaneously.

10. The method of claim 9, further comprising masking the first surface before removing the catalyst through the second surface without substantially removing the catalyst through the first surface.

11. The method of claim 1, wherein substantially removing the catalyst from the volume of the polycrystalline diamond material comprises leaching the catalyst.

12. The method of claim 1, further comprising providing a backfill material into the volume of the polycrystalline diamond material.

13. The method of claim 12, wherein the catalyst and the backfill material each comprise substantially the same material.

14. The method of claim 12, wherein the backfill material exhibits a coefficient of thermal expansion lower than a coefficient of thermal expansion of the catalyst.

15. The method of claim 1, wherein selecting a leach depth from a first surface of the polycrystalline diamond material and wherein selecting a different leach depth from a second surface of the polycrystalline diamond material comprises selecting the leach depth and the different leach depth to be in a range from about 100 μm to about 1000 μm.

16. The method of claim 1, wherein substantially removing the catalyst from a volume of the polycrystalline diamond material from the first surface to the leach depth to form a first leached region adjacent an unleached region comprises forming a boundary between the first leached region and the unleached region that is substantially planar.

17. The method of claim 1, wherein substantially removing the catalyst from a volume of the polycrystalline diamond material from the second surface to the different leach depth to form a second leached region adjacent the unleached region comprises forming a boundary between the second leached region and the unleached region that is substantially cylindrical.

* * * * *